US006039393A

United States Patent [19]

Roh

[11] Patent Number: 6,039,393

[45] **Date of Patent: *Mar. 21, 2000**

[54] PROTECTIVE COVER FOR BABY SEATS

[76] Inventor: Warren E. Roh, 7753 S. Ames Way, Littleton, Colo. 80123

[ * ] Notice: This patent is subject to a terminal disclaimer.

[21] Appl. No.: 09/073,002

[22] Filed: Apr. 15, 1998

Related U.S. Application Data

[63] Continuation of application No. PCT/US96/15553, Sep. 27, 1996, which is a continuation-in-part of application No. 08/593,074, Jan. 29, 1996, abandoned.

[51] Int. Cl.[7] ..... A47D 15/00

[52] U.S. Cl. ..... 297/184.13; 297/184.15

[58] Field of Search ..... 297/184.13, 184.1, 297/184.11, 184.15, 184.17, 219.12, 250.1; 428/36.1, 255; 296/77.1

[56] References Cited

U.S. PATENT DOCUMENTS

| | | | |
|---|---|---|---|
| 692,501 | 2/1902 | Bentley . | |
| 780,288 | 1/1905 | Hassemer et al. . | |
| 1,033,108 | 7/1912 | Lehmann . | |
| 1,257,206 | 2/1918 | Fernbach . | |
| 1,289,965 | 12/1918 | Tichenor | 296/77.1 |
| 1,339,527 | 5/1920 | Sperling et al. . | |
| 1,412,935 | 4/1922 | Greenebaum . | |
| 1,732,878 | 10/1929 | Collender . | |
| 1,770,841 | 7/1930 | Clyman . | |
| 2,218,043 | 10/1940 | Lilleberg | 296/79 |
| 2,546,843 | 3/1951 | Zigterman | 5/364 |
| 2,735,716 | 2/1956 | Shimabukuro | 296/78 |
| 3,193,322 | 7/1965 | Hines | 296/77.1 |
| 4,583,779 | 4/1986 | Myers | 297/184 |
| 4,666,207 | 5/1987 | Quartano | 297/229 |
| 4,716,594 | 1/1988 | Shannon | 2/4 |
| 4,810,030 | 3/1989 | Lewis | 297/184 |
| 4,946,221 | 8/1990 | Livingston | 297/184 |
| 4,947,883 | 8/1990 | Mayo | 135/90 |
| 4,997,231 | 3/1991 | Smith | 297/184 |
| 5,074,616 | 12/1991 | Smith | 297/184 |
| 5,184,865 | 2/1993 | Mohtasham et al. | 296/77.1 |
| 5,301,999 | 4/1994 | Thompson et al. | 297/184.13 |
| 5,308,139 | 5/1994 | Rieger | 297/184.11 |
| 5,309,586 | 5/1994 | Sies et al. | 5/482 |
| 5,432,965 | 7/1995 | Espinoza | 5/482 |
| 5,522,639 | 6/1996 | Jaime | 297/184.13 |
| 5,549,354 | 8/1996 | Rosen | 297/184.13 |
| 5,730,490 | 3/1998 | Mortenson | 297/184.13 |

OTHER PUBLICATIONS

U.S. application No. 60/006,011 Mortenson et al.

"Tiny Tent," Made by Nirin, Inc.

*Primary Examiner*—Peter R. Brown
*Attorney, Agent, or Firm*—Thomason, Moser & Patterson

[57] ABSTRACT

A protective cover (10) is disclosed that can be interchanged among a variety of baby seats. It includes a canopy (11) and a sealing element (22) that can interchangeably and flexibly seal around a variety of baby seats. It may also contain a removable hood (20) that may shield a portion of an insect resistant mesh (15) so that a side mesh (15*b*) remains open for air and viewing of the occupant under the protective cover (10). Furthermore, the hood (20) may be attached at an approximate midpoint (26) of the canopy (11) to allow versatility in deploying the hood in a rearward direction and fastening the hood with attachment element (38). Likewise, the hood (20) may be folded in a forward direction and attached with attachment element (38) to a forward contour of a baby seat. The protective cover may include a protective foot shield (14) located under the hood (20) that may protect, for instance, feet of an occupant from a stinger or biting proboscis of a flying insect when the feet may touch the inside surfaces of the cover. Another feature of the present invention may include the ability of the present invention to be folded to a reduced state for easy storage and held in the reduced state by an integral restraining element which could be the hood (20). Another feature could be an inclement weather filtering configuration of mesh that could be located on the side to filter light, for instance, to a reduced level for the occupant's comfort.

24 Claims, 6 Drawing Sheets

PROTECTIVE COVER FOR BABY SEATS

This application is a continuation of International Patent Application No. PCT/US96/15553, filed Sep. 27, 1996, which is a continuation-in-part of U.S. patent application Ser. No. 08/593,074, filed Jan. 29, 1996 now abandoned.

I. TECHNICAL FIELD

This invention relates to accessories for baby seats. More specifically, it relates to a protective cover for baby seats.

II. BACKGROUND ART

Babies are routinely transported from one location to another in baby seats. Vehicle seats, generically referred to as car seats, are used to protect babies while riding in automobiles, large and small trucks, recreational vehicles, and aircraft, and other such transportation devices.

Babies are placed in automatic swings and gliders for relaxation and entertainment. Swings differ from gliders in that swings traverse an arc while gliders traverse a level plane. Seats used with automatic swings and gliders are similar to vehicle and baby seats.

Towels and blankets are often placed over a baby or vehicle seat to protect the occupant from elements such as sun, rain, and snow. This practice is common when babies are hand-carried out-of-doors while seated in a carrier. Covering a seated baby with a towel or blanket may reduce the baby's ventilation, visibility, and comfort. Many baby seats now offer as standard equipment or as an option a half domed sun shade that provides protection from the sun.

Child care product suppliers have addressed the need for sun shades for many years. More recently, U.S. Pat. No. 5,301,999 to Thompson and Thompson (1994) addresses protection against sun for a baby car seat; however, the Thompsons' patented apparatus may be considered impractical and consists of a complex support structure that positions a sun shade between the sun and the baby. In a moving vehicle, the Thompsons' apparatus may need continuous adjustment to keep the sun shade positioned between the seated baby and the sun. U.S. Pat. No. 4,997,231 to Smith (1991) discloses a sunshade apparatus that may require a seat equipped with a U-shaped handle. However, the Smith patent appears to only addresses sun protection, and when installed on the seat, the sunshade partially blocks the grip area of the handle. Partial blocking of the handle does not appear to allow for the sunshade's use on several type handle equipped automatic swing and glider seats. Several manufacturers' seat and carrier designs allow the handle to be folded below the seat to vary the seat's angle relative to a supporting surface. When a handle is used below the seat, a handle attachment of a sunshade or cover is not convenient. U.S. Pat. No. 4,947,883 to Mayo (1990) discloses a sunshade apparatus that addresses protection against sun for a seated baby by providing a wrap around channel of photochromic material mounted between the baby and the sun. The Mayo apparatus appears complex, bulky, and seems to address only sun protection.

While many present day configurations have emphasized the shading from the sun, few have appreciated the overall need to shield from inclement weather while allowing airflow through side mesh vents. Furthermore, by providing side mesh vents, increased visibility of the occupant is enhanced. Prior to the present invention, no invention appears to have combined the overall protection from inclement weather while providing side ventilation. Furthermore, prior to the present invention, no solution offered a specifically enhanced foot shield to shield the feet of an occupant from biting or stinging insects. Apparently, it has not been considered that the feet of a typical occupant touch the inside surface of the cover such that a proboscis of a mosquito or other insects could be inserted through the cover to actually sting or bite the occupant. Furthermore, until the present invention, it was simply not considered that the location for the attachment of the hood could actually enhance the versatility of the protective cover. Also, prior to the present invention, it was not considered that the portability and flexibility of the protective cover could be contained within an integral restraining element such that the user of the protective cover could carry the cover in a variety of positions and places. While the elements and the materials have long been available and certainly the long felt unsatisfied need existed, apparently the various features have simply not been appreciated. Those skilled in the art have appreciated that the problem existed, but simply directed their efforts away from the focuses of the present invention. While they made substantial attempts, in attempting to fulfill the need, they failed to understand the various intricate problems and particularly with combining the features into the particular invention. As discussed above, many of the protective covers taught away from the direction of the present invention in that they focused on avoiding direct sunlight via shades or providing a cover that essentially duplicated the function of the typical towel that is draped over a seat.

Thus, until the present invention, there remained a need for a collapsible, reducible state protective cover that could be interchangeably affixed to various baby seats that could provide coverage in inclement weather as well as adequate ventilation even while the inclement weather hood covered the protective cover. Likewise, there existed a need for a versatile hood that could be removably attached in a variety of positions and included a protective foot shield that would protect an occupant from stings that could occur through a mesh where parts of the body touched the mesh.

III. DISCLOSURE OF THE INVENTION

Thus, the present invention fulfills a long felt but unsatisfied need in protecting infants and small children in baby seats. It generally provides a weather cover to transport the baby in sun, rain, snow, wind, and other inclement weather conditions and yet may provide a well ventilated way to transport the baby. Touching by pets and strangers is discouraged when using it while shopping or outdoors. It may include a fine weave mesh that keeps out even small flying insects. Furthermore, it may fold into itself for easy storage, may install in seconds over baby seat, and may be universally configured to be used on a wide variety of shapes and sizes of baby seats such as car seats, carriers, swings, bouncers, and so forth. Additionally, in some seats used in vehicles, many manufacturers recommend lowering a seat handle. Thus, a handle might be unavailable to support the protective cover. This invention in a preferred embodiment supplies a self-supporting cover. Furthermore, in the preferred embodiment, it typically does not interfere with many vehicle restraints included in vehicles.

One aspect of the present invention is that it provides for a side venting enclosure such that the ventilation continues while an inclement weather hood is in place to protect the baby from the inclement weather. Another advantage of the side vented window is while the infant is protected, the infant still may be viewed and thus give a peace of mind to the mother or other care taker of the baby or other occupant that could typically be situated in these type of seats.

Because of this versatility, the protective cover may be used outside such as with a swing where insects might bite or sting the infant, and yet the infant might see outside the cover and more likely enjoy the time in the cover. Compared to the general state of art prior to this invention, the occupant was covered with a opaque cover so that the occupant could not see outside.

Another advantage of the present invention is that it provides a hood that may be attached to approximately the midpoint of the canopy so that the hood may be retained in an unhooded direction thus opening the screen for viewing, and with the same hood, be easily retained in a forward direction to protect the baby from inclement weather.

Another major aspect of the present invention is to provide a protective foot shield that resists the entry of an insect, such as a mosquito proboscis or stinging insect. This is an advantage over other inventions in that the baby still may be viewed from the outside through the mesh or screen, and yet be protected where its feet might touch the cover and thus the insect proboscis could otherwise protrude through the mesh.

Another advantage of the present invention is that it is able to be retained in a reduced state through an integral restraining element for easy portability such as placement in backpacks, purses, grocery shopping carts, and so forth.

Accordingly, several objects and advantages of the present protective cover invention are:

a) to provide a cover that surrounds a seated occupant with a dome-shaped enclosure;

b) to provide a cover that offers a seated occupant significant protection from primarily flying insects;

c) to provide a cover that provides a seated occupant shade from the sun;

d) to provide a cover that incorporates an inclement weather feature for protecting a seated occupant from conditions such as cold, rain, wind, and snow while a seat is being carried out-of-doors;

e) to provide a cover that affords protection for a seated occupant from lightweight, windblown debris, such as leaves and seed pods.

f) to provide a cover that discourages unauthorized handling or touching of a seated occupant by passersby or animals when a baby seat is temporarily unattended by a guardian;

g) to provide a cover that offers a seated occupant a degree of protection against disease-causing saliva aerosol when someone sneezes or coughs outside of the cover's protective environment;

h) to provide a cover that is well-ventilated;

i) to provide a cover that does not appreciably attenuate or distort sound;

j) to provide a cover that allows good visibility for both a seated occupant and guardian;

k) to provide a cover that fits most baby seats including baby carriers, vehicle seats, and automatic swing or glider seats;

l) to provide a cover that installs and removes quickly and easily;

m) to provide a cover that is lightweight, attractive, and compact when stowed;

n) to provide a cover that is adaptable for use in cold, moderate, and tropical climates.

One goal of the invention is to provide a protective cover for a baby seat holding an occupant that includes an enclosing canopy where the enclosing canopy includes at least a portion of some insect resistant mesh, a sealing element to seal the canopy around the baby seat with a supporting element attached to the canopy and a hood that may be attached to the canopy in the vicinity of a midpoint of the canopy with an attachment element that retains the hood in an unhooded rearward direction away from the insect resistant mesh. When the hood is being used, the attachment element may retain it in a partially hooded forward direction over the mesh. One object of this goal is to provide at least two canopy sections where a supporting element may be located in the vicinity of the juncture between the canopy sections. The canopy sections may be located in the vicinity of the middle of a longitudinal direction of a canopy. Furthermore, the hood may originate along a length of the supporting element to establish a hood base width. This base width, if less than the length of the supporting element, may provide an unhooded portion of the insect resistant mesh when the hood is in use and overlapping the remainder of the mesh. If the cover generally is flexible, it may be compressed into a reduced state. Thus, one object of the goal would be to provide an integral restraining element that typically could be attached to the cover so that when the cover is in a reduced state it retains it into the reduced state. Another aspect of this goal would be to provide a supporting element that is resilient and may also be folded to a reduced state so that when the integral restraining element overlaps the cover, it also overlaps the supporting element in the reduced state. Another object of this goal is to provide a cover that may be retained in a substantially planer configuration when it is not in use for easy storage. Another object may be to provide an insect resistant mesh that is a fine weave, resistant to even small insects. A mesh of this style provides a very fine weave that even small flying insects have difficulty penetrating.

Another goal of the present invention is to provide a protective cover for a baby seat holding an occupant that includes a flexible supported canopy with a top, a sealing element, a top mesh, a side mesh, and a side venting hood. The sealing element may seal the canopy around the baby seat so that flying insects would have difficulty penetrating the seal. Small crawling insects, however, such as ants, could penetrate the seal. This protective cover may include a top mesh to resist insects attached to the canopy on the top. By attached, the mesh may be sewn to the canopy (and in a more general sense, the protective cover), bonded to the canopy, integral to the canopy, or any other attachment means known to those in the art. Generally, the top mesh may be located so that others outside the canopy may view the occupant under the canopy. A side mesh may also be included in the protective cover to likewise resist the entry of flying insects. It may be attached to one of the sides or all of the sides. It may be integral to the top mesh or it may be physically separated from the top mesh. By the term side mesh, it is meant to include a portion of the canopy that is more vertical than horizontal. Another part of the canopy may include a side venting flexible hood that would cover the top mesh to protect from inclement weather, but leave a remaining portion of the side mesh open generally for ventilation and viewing. One object of this goal is to provide a flexible hood that may terminate at an approximate boundary, imaginary or real, between the top mesh and side mesh. Another object of this goal is to provide a supported canopy that is supported by a supporting baby seat element. A further object is to provide a supporting element that provides a supporting length having end points, such that a hood may originate along the supporting length to establish a base hood width. In one embodiment, the base hood width may be less than the supporting length so that a hood in use may leave an unhooded portion of the side mesh. Another object of this goal is to provide a hood with a base which is aligned transversely with respect to a long dimension of the cover. Likewise, the hood could be aligned longitudinally with respect to the long dimension. Another object of this goal is to provide a self-venting flexible hood attached to the canopy in the vicinity of the midpoint of the canopy. Likewise, another object is to provide a foot shield to protect the feet of the occupant. Another object is to provide a hood having two sections that may each independently be deployed to cover at least a portion of the mesh. Another object of this goal is to provide a hood that provides a plurality of layers. The layers could include, for instance, a translucent layer and an opaque layer. Another object is that the supported flexible canopy includes at least one supporting member which could be resilient.

Another goal of the present invention is to provide a protective foot shield in a protective cover. This embodiment could include a supported canopy with a top inside, a sealing element to seal the canopy around the baby seat, an insect resistant mesh attached to the canopy, and a protective foot shield located at least on a portion of the top and sides of the canopy, and a terminus point. The terminus point would affect the length of the protective foot shield so that it would cover the feet touching the canopy and terminate the foot shield in an appropriate location to cover the feet. One object of this goal is to include an insect resistant mesh that would include at least a portion of one of the sides of the cover. A hood could be provided that could surround the whole of the insect resistant mesh or a portion of it by leaving open one of the sides of mesh, as an example. Another object of this goal would be to allow air flow into the canopy even if the hood covered a significant portion of the insect resistant mesh through, for instance, a venting side mesh.

A further goal of the present invention is to provide an integral restraining element to restrain the cover in a folded, reduced state when the cover was not being used as a protective cover over an occupant. This embodiment may provide a flexible canopy with a top and at least one side, a sealing element to seal the canopy around the baby seat, an insect resistant mesh attached to a canopy, and an integral restraining element that may restrain the cover in the folded, reduced state. Likewise, one object of this goal may be to provide a protective foot shield to protect the feet of the occupant. If the flexible canopy were supported, it could be provided with a supporting resilient element that could likewise be folded to the reduced state such that the integral restraining element would restrain it as well. Another object of this goal would be to provide an insect resistant mesh on at least one side of the canopy in a position so that a flexible hood might not hood at least a portion of the mesh on the side. Another object could be to provide a hood that is attached in the vicinity of the midpoint of the canopy. Still, a further object could be to provide an integral hood to function partly as an integral restraining element such that the protective cover could be restrained within the reduced state using the integral hood. Alternatively, another object could be to provide an integral pocket to function partly as an integral restraining element such that the cover could be restrained in the integral pocket in the reduced state. A further goal could be to provide at least one securing element such as snaps or hook and loop fasteners, such as Velcro®, to secure the integral restraining element.

Naturally, further objects of the invention are disclosed throughout other areas of the specification and claims.

IV. BRIEF DESCRIPTION OF THE DRAWINGS

Figure 2:
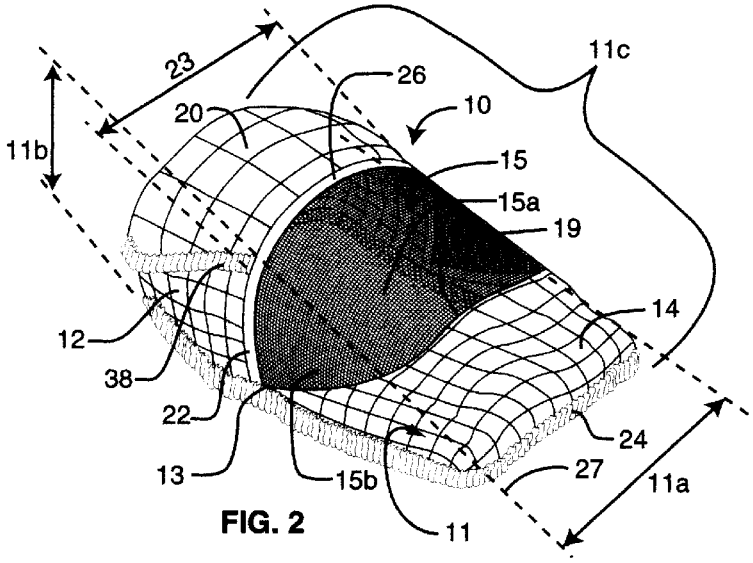
FIG. 2 shows the hood in a retracted rearward direction with the mesh fully exposed and contains more details showing the goals of the present invention.
Figure 2A:
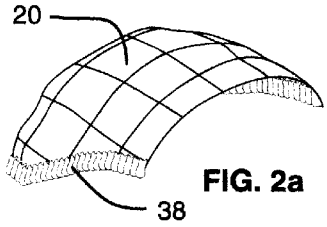

FIG. 2*a* shows a separate view of the hood.

Figure 2B:
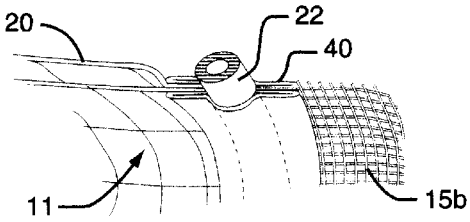

FIG. 2*b* shows, from an inside perspective, portions of various components of the present invention, including a hood attached in the vicinity of a supporting member adjacent to a section of mesh.

Figure 2C:
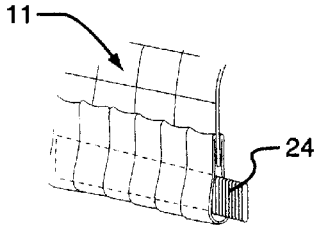

FIG. 2*c* shows one embodiment of an attachment means, which can include an elastic band or string.

Figure 2D:
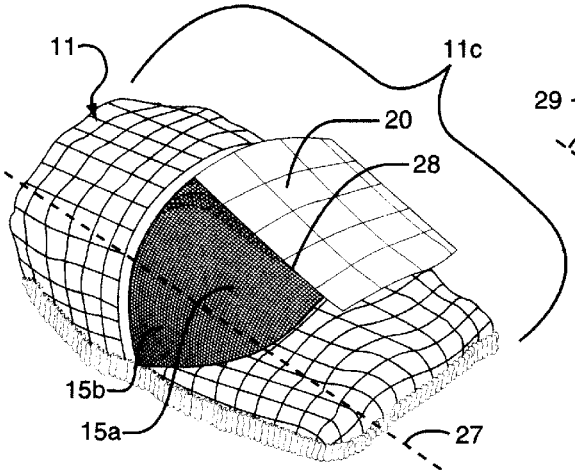

FIG. 2*d* shows a hood attached in a longitudinal orientation.

Figure 2E:
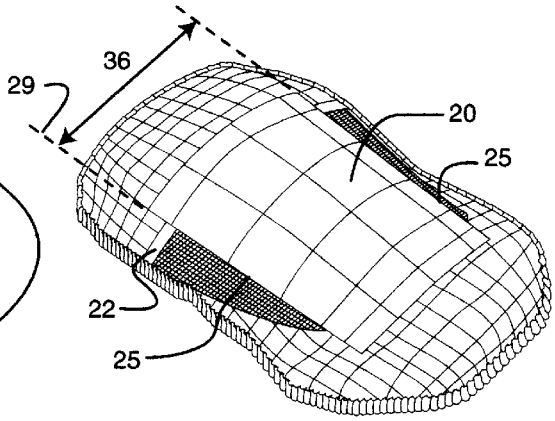

FIG. 2*e* shows a hood attached rearward of a supporting member and intersecting the supporting member along a line of sight to establish an intersection length.

Figure 2F:
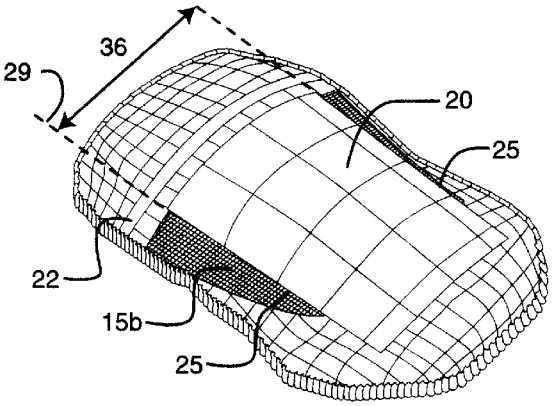

FIG. 2*f* shows the hood attached forward of the supporting member, yet intersecting along a line of sight to establish an intersection length.

Figure 2G:
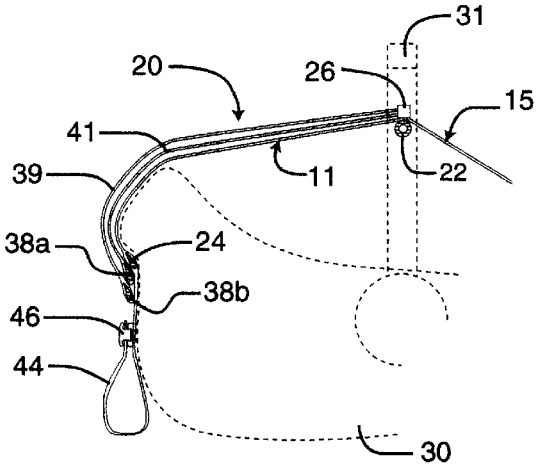

FIG. 2*g* shows an alternate embodiment of the hood with a plurality of layers for various purposes including a translucent and opaque layer; it also shows an integral pocket for storage of the protective cover in a reduced state when the cover is not in use as a protective cover over the occupant.

Figure 2H:
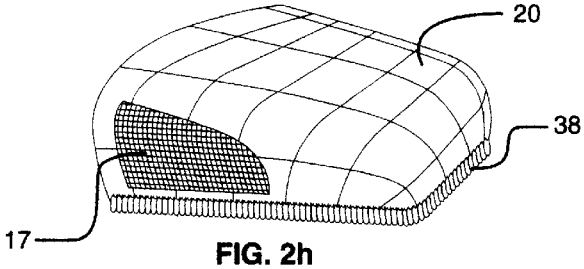

FIG. 2*h* shows a window in a hood that may offer additional protection over the hood embodiment shown in FIG. 2*a*.

Figure 2I:
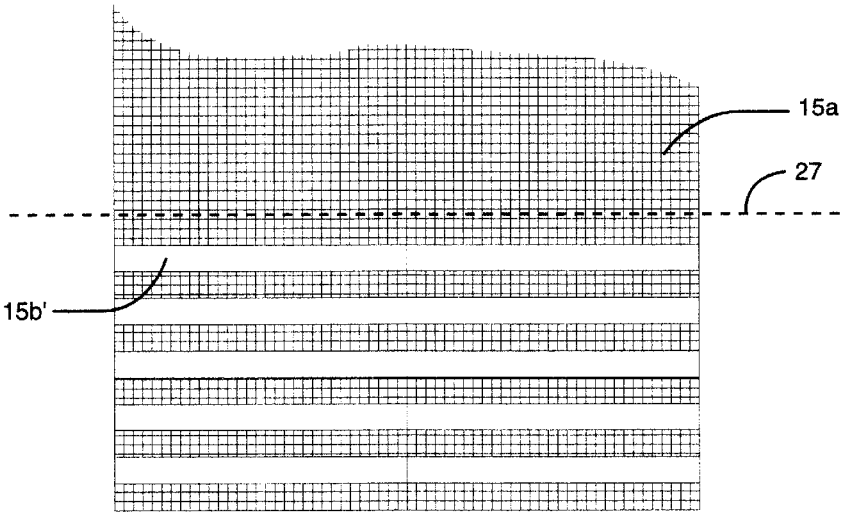

FIG. 2*i* shows a side elevation view of a portion of side mesh shown in FIG. 2 attached to a section of top mesh shown in FIG. 2 and a portion of mesh used in a window in FIG. 2*h*.

Figure 2J:
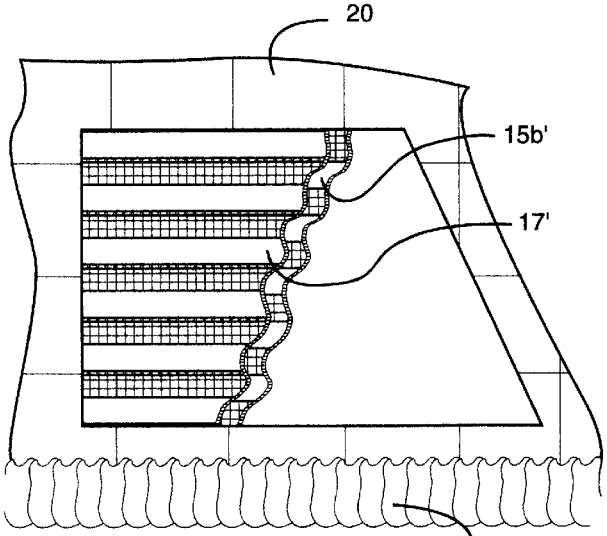

FIG. 2*j* shows a cut away view of one embodiment of a possible relationship between a side striped mesh shown in FIG. 2 overlapped by a window striped mesh shown in FIG. 2*h*.

Figure 1:
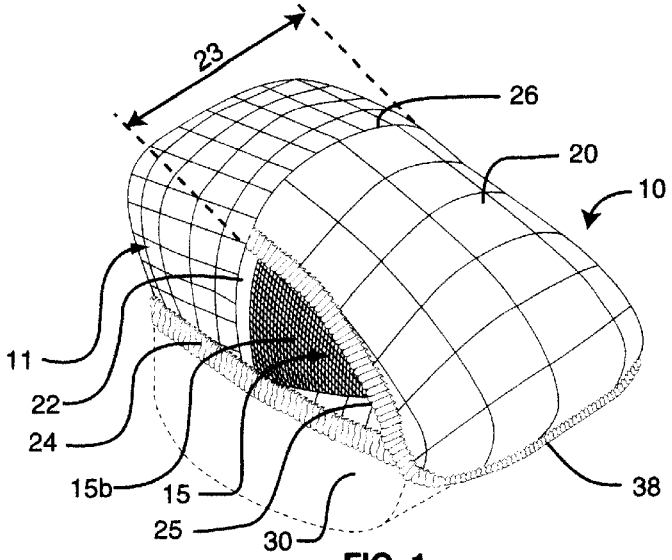
FIG. 1 is a perspective of the general aspects of the present invention showing a hood in a partial covering mode with at least a portion of a side mesh still exposed and the hood attached approximately in the middle of the protective cover.
Figure 2K:
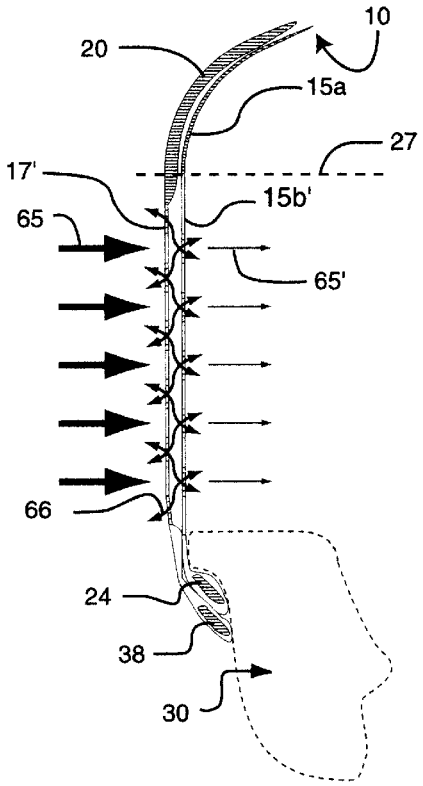

FIG. 2*k* shows a cross-sectional assembly view of FIG. 1 combined with FIGS. 2*h* and FIG. 2*i* including a side striped mesh in FIG. 2 overlapped by a window striped mesh in FIG. 2*h* when a cover is installed on a seat and a hood is deployed over the forward portion of the cover.

Figure 3A:
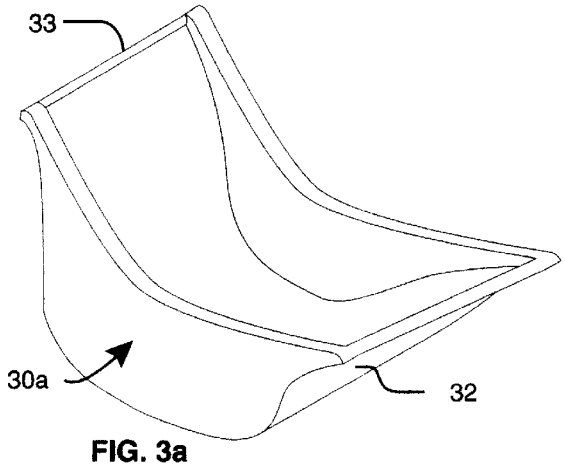
Figure 3B:
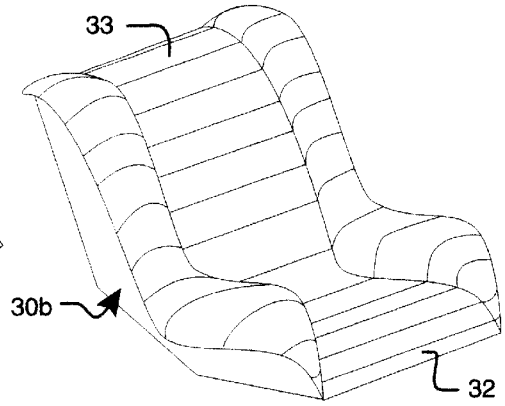
Figure 3C:
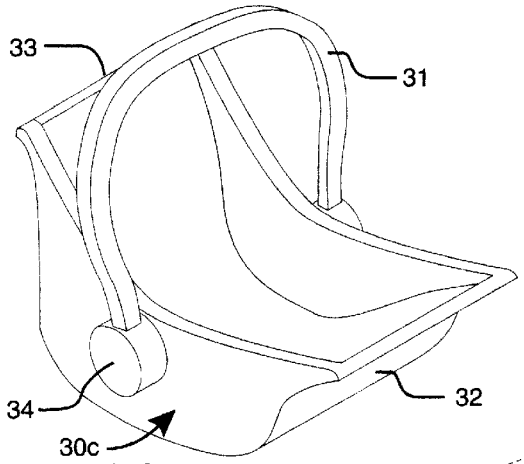

FIGS. 3*a–c* illustrate typical types of seats used such as vehicle, carrier, swing, or glider seats which the present invention may fit in an interchangeable manner.

Figure 4:
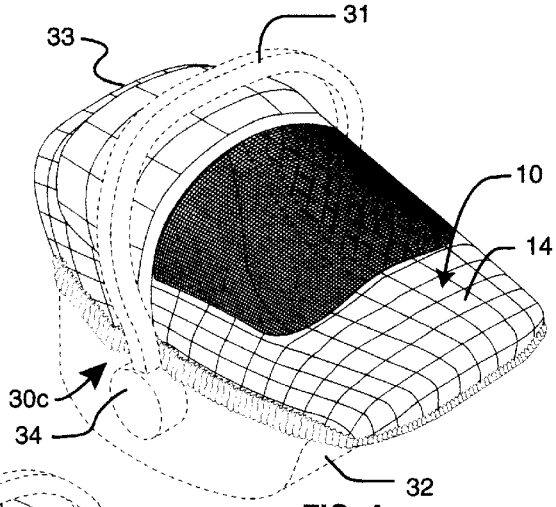

FIG. 4 shows how the present invention may work independently of an attached handle found on a typical baby seat.

Figure 5:
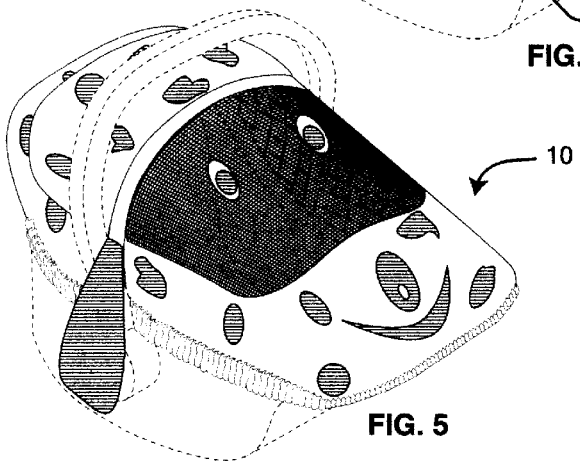

FIG. 5 shows an alternate embodiment for entertainment purposes of the present invention.

Figure 6:
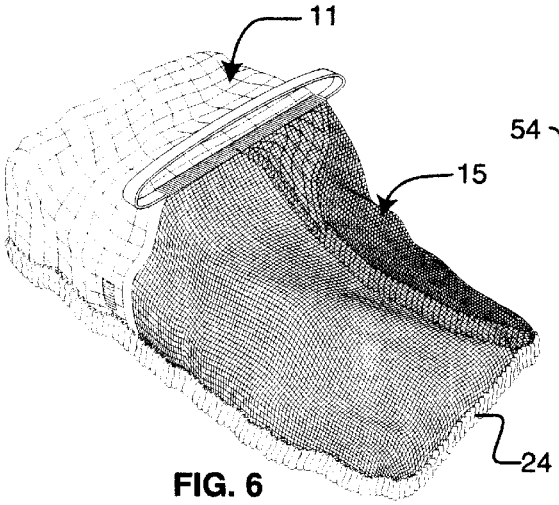

FIG. 6 shows an alternate embodiment of the present invention with a larger mesh section extending to the outer periphery of the protective cover.

Figure 7:
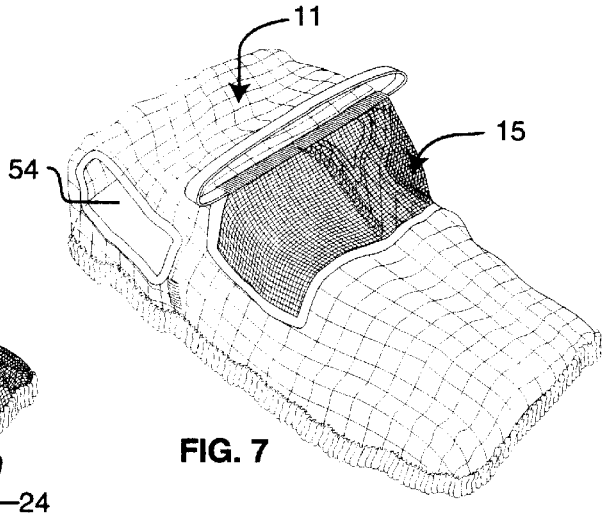

FIG. 7 shows another alternate embodiment of the present invention with a reduced mesh section and rearward side viewing window.

Figure 8:
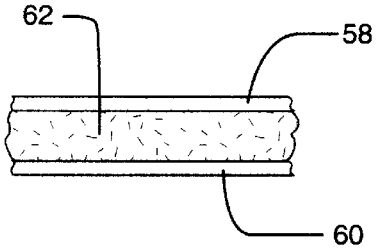

FIG. 8 shows a cross-section of a canopy of an insulated covered embodiment.

Figure 9:
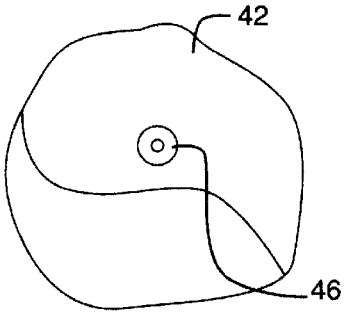

FIG. 9 shows an integral restraining element surrounding the protective cover in a reduced state and secured by a securing element.

Figure 10:
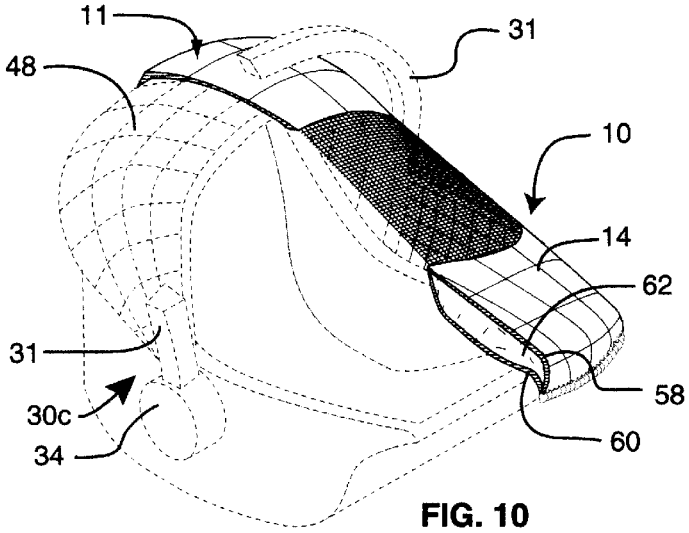

FIG. 10 shows an embodiment using a supporting baby seat element from a baby seat to support a protective cover.

Figure 11:
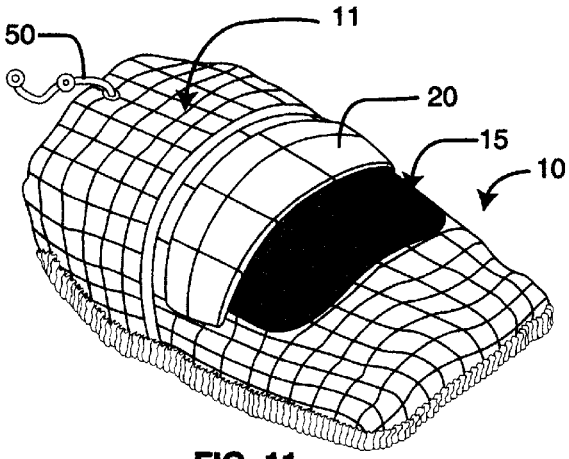

FIG. 11 shows another embodiment of the present invention showing a partially hooded protective cover embodiment.

Figure 11A:
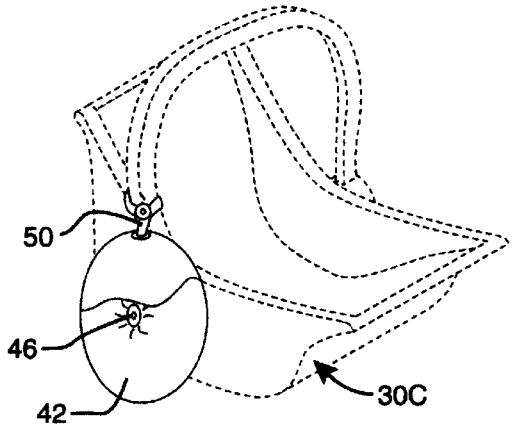

FIG. 11*a* shows a protective cover carrying element used to carry and conveniently place the cover when not in use.

Figure 12:
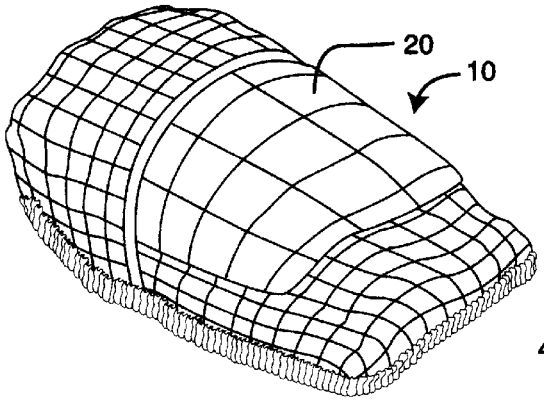

FIG. 12 shows an embodiment that covers the mesh for generally more severe inclement weather.

Figure 13:
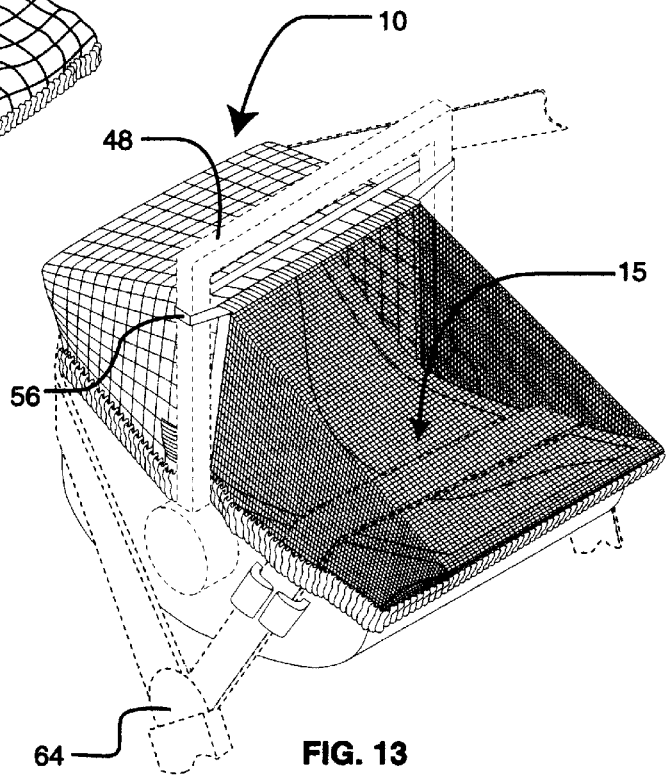

FIG. 13 shows another embodiment that is a supported cover using a cover attachment support to secure the cover to a supporting baby seat element such as an attached handle.

V. BEST MODE FOR CARRYING OUT THE INVENTION

As can be easily understood, the basic concepts of the present invention may be embodied in a variety of ways. It involves both methods and devices to accomplish the appropriate method. In this application, the methods are disclosed as part of the results shown to be achieved by the various devices described and as steps that are inherent to utilization. They are simply the natural result of utilizing the devices as intended and described. In addition, while some devices are disclosed, it would be understood that these not only accomplish certain methods but also can be varied in many ways. Importantly, as to the foregoing, all these facets should be understood to be encompassed by this disclosure.

As mentioned earlier, the present invention includes a variety of components that may be used in different combinations, depending on the application that needs to be addressed. The invention is designed primarily to take advantage of a unique protective cover apparatus and method of protecting occupants of baby seats and combine and modify it as needed for a variety of shapes, sizes, and orientations, as will be explained in more detail as the figures are described. This invention is intended to encompass a wide variety of uses in the goals and objects of the protecting cover. Elements, functions, and procedures that distinguish the present invention will be noted where appropriate.

As broadly shown in FIG. 1, the protective cover (10) shown and described as the present invention may be a composite of the canopy (11), sealing element (24), mesh (15), and sometimes the hood (20) and supporting element (22), specifically shown in FIG. 2. The protective cover (10) may be suited for cold weather where the canopy (11) may have an insulation layer in the cover and offer, perhaps, less screen mesh for exposure. Alternatively, the protective cover (10) may be less insulative and more open containing more mesh in warm weather. It is intended to be interchangeable between a wide variety of seats. It is also intended to discourage touching from strangers or pets by an enclosing protective cover.

Its interchangeability is seen for instance in FIGS. 3*a–c*. In FIG. 3*a*, a typical non-handle equipped baby seat is shown for infants and is basically a turtle shell-like basket having an open top perimeter with cushions. FIG. 3*b* illustrates a typical infant through toddler seat which has a slightly larger head at the top and may sit more upright when installed in a vehicle. In FIG. 3*c*, the seat is similar to FIG. 3*a* with the exception of the handle (31) which pivots about a pivot point (34) and is found on many seats for carrying the baby seat. The term "baby seat" as used herein is intended to include those shown in FIGS. 3*a–c* as well as a wide variety of various seats such as car seats, vehicle seats, baby seats, glider seats, automatic swing seats, and so forth encompassing any suitable seat which may be a surface where babies and infants or even toddlers (generally referred to as occupants) may be placed.

FIG. 2 shows the invention in more detail. In that figure, the hood (20) is folded back in an unhooded manner. The insect resistant mesh (15) may include at least two parts. The first part is a top mesh (15*a*). The top mesh (15*a*) may be located on the top (11*a*). The top (11*a*) is generally a more horizontal or lateral surface compared to the side (11*b*). An advantage of the mesh of side (11*b*) may be a low sun angle such that the occupant is not exposed to intense sun rays from a top angle that could more directly affect the top mesh. The canopy (11) generally may consist of the majority of fabric or material (flexible or non-flexible) used to create the present invention other than the insect resistant mesh (15). A first enclosing canopy section (12) may be attached to a second enclosing canopy section (13). Located between the first enclosing canopy section and second enclosing canopy section may be the supporting element (22) to support the enclosing canopy (11). Surrounding the canopy (11) may be a sealing element (24). The sealing element (24) is shown in more detail in FIG. 2*c*. The sealing element (24) may be an elastic band enclosed in the canopy (11) or it may be a simple drawstring or other appropriate sealing element to seal the canopy. The first enclosing canopy section (12) and second enclosing canopy section (13) may join in the vicinity of a midpoint of the canopy (26). Also, at this location, the supporting element (22) may be used. The supporting element (22) has a length. Intersecting that length may be a hood (20) which may have a base hood width (23) that may be less than the length of the supporting element (22). An advantage of this embodiment is that when the hood (20) is deployed in a forward direction to cover the top mesh (15*a*), then the side mesh (15*b*) remains open to air flow inside. The side mesh (15*b*) also allows side viewing of the occupant from outside the protective cover. Yet, the cover still assists in protecting the occupant from inclement weather such as snow, rain, or the heat of the sun from sunlight, or other bright light.

Additionally, the hood may terminate at an approximate boundary (27) between the top mesh and side mesh, as shown in FIG. 2. The approximate boundary may be defined as a line separating the primarily horizontal top portion from the primarily vertical side section. Thus, the top portion would primarily be a horizontal section from one side of the cover to the other as shown by the top (11*a*), while the side section could primarily be the vertical section shown as side (11*b*). The cover may have a length from front to back as shown by long dimension (11*c*).

In the vicinity of a midpoint of the long dimension (11*c*), the hood (20) may be attached to the cover. The term "vicinity" as used herein is intended to mean that the location could vary by a few inches so that, as in this case, the hood could still be used in a rearward direction and in a forward direction. While this dimension could vary a few inches, it would typically be less than a one foot variance. An attachment element (38) of the hood (20) may be used to restrain the hood in place in a rearward direction, as shown in FIG. 2, and likewise in a forward direction, as shown in FIG. 1. The attachment element could be an elastic band or drawstring, or other appropriate restraining element similar to sealing element (24).

Also shown in FIG. 2 is a protective foot shield (14). The protective foot shield may terminate at a terminus point (19). One useful attribute of the foot shield (14) is that it may be made from a material that would reduce the proboscis penetration of flying insects such as mosquitos or the stinger penetration of bees, and so forth. For instance, mosquitos have a long proboscis that may be inserted through even a fine mesh. While the mesh may resist the penetration of the flying insect itself, the mesh perhaps might not resist the proboscis penetration or stinger penetration of the flying insect. An occupant under the protective cover (10) might have its feet, hands, or some extremity touching the mesh. Thus, the proboscis of a mosquito might penetrate to still draw blood or the stinger of a bee might penetrate to sting. The protective foot shield could be made of different material than mesh to reduce this penetration. Likewise, the concept could be equally applicable to other stinging insects or even mandibles of other insects. Because the protective foot shield (14) may terminate at the terminus point (19), the feet of the occupant could be protected. Yet the rest of the occupant's body, that typically might not touch the actual cover material, might not need the protective foot shield and only need the insect resistant mesh (15). Obviously, variations of the shape, size, and length of the mesh are available commensurate with the objects and the goals of the present invention.

FIG. 2*a* shows a detail of the hood (20) separated from the canopy. In some embodiments, the hood could be a separate item from the canopy (11) that could be removable, temporarily attached through such items as snaps, hooks and loops, or even simply a partially separate cover.

FIG. 2*b* shows an inside view of the protective cover detailing a juncture (40) at which the hood (20) might be attached to the canopy (11). Also shown in FIG. 2*b* is a supporting element (22) to support the canopy. The supporting element (22) is shown as a round supporting member. The supporting element may be used to support the cover away from the occupant. By the term "away," it is intended that the cover not simply lay on the occupant in an unsupported manner. This round supporting member may afford an advantage in being resiliently folded to a reduced state when the cover is not in use. Alternatively, other shapes could be elliptical, rectangular, square, or other cross-sectional shapes. It may be integrated with the canopy (11) and may be situated at the juncture (40) between the first enclosing canopy section (12) and the second enclosing canopy section (13). While the location of the mesh is variable, one embodiment shows the second enclosing canopy section (13) as containing a portion of the insect resistant mesh (15).

FIG. 2*c* shows how the protective cover may be sealed about the baby seat of FIGS. 3*a–c* as a typical example. The sealing element (24) that may seal the canopy about the occupant's feet may include an elastic band that may be incorporated into the canopy (11) or a drawstring or other sealing elements. The sealing element is primarily intended to resist the entry of flying insects and large crawling insects. Also, the location of the sealing element (24) is shown toward the bottom of the side edges. Naturally, other locations of sealing could be obtained. For instance, the side edge could be sealed at a place other than the lower edges.

FIG. 2*d* shows an alternate variation of the attachment of the hood (20). Along the long dimension (11*c*), of the canopy (11), the hood (20) may be attached in a longitudinal fashion so that a longitudinal base (28) may be aligned with the long dimension (11*c*). This embodiment could have some preference by some consumers in allowing them to view the occupant more freely while only partially covering the top mesh (15*a*). Obviously, it could be located at a point closer to the side mesh (15*b*) as well. Thus, perhaps it could cover the top and opposite side to the side mesh (15*b*), leaving exposed only one side mesh. Alternatively, it could be attached in the middle longitudinally where the hood was made in two facing pieces (similar to a book cover) where one face could be deployed to the left and another face deployed to the right to cover the top section (15*a*) and leave a portion of either or even both side meshes open. Thus, the hood (20), even attached longitudinally at a longitudinal base, could provide side venting capabilities for air flow into the canopy (11).

FIGS. 2*e* and 2*f* show alternate locations for the hood (20). For instance, if supporting element (22) has a length and a hood is attached transverse to the long dimension (11*c*), then generally the hood side edges (25) would intersect, through a line-of-sight (29), the supporting element (22). FIG. 2*e* shows the hood (20) attached rearward of the supporting element (22). Naturally, as shown in FIG. 2*f*, the hood could be placed forward of the supporting element (22) such that the hood side edges (25) physically did not intersect or cross over the supporting element (22). However, in either case (and others), through the line-of-sight (29), the side edges (25) could intersect the supporting element (22). Generally speaking, in the preferred embodiment, the intersection length (36) could be less than the length of the supporting member (22) so that when the hood (20) was deployed in a forward direction, there remained an open portion of the side mesh (15*b*).

FIG. 2*g* shows an alternate embodiment of the hood (20). The hood (20) may include a plurality of layers. For instance, FIG. 2*g* shows two layers. One layer may be a translucent layer (39) that may be tinted or clear and may be some flexible plastic or material. It could be some other suitable material including a more solid sheet of material. Its usefulness may be seen in instances where the weather was somewhat cold, but clear, in which the occupant could be shielded with a translucent layer (39) that would allow sun to radiate into the volume of the protective cover and also allow the occupant to be viewed from the outside. Either in conjunction with translucent layer (39) or independent of translucent layer (39), an opaque layer (41) could be used. The opaque layer (41) could be a bright white for heat reflective properties. In the preferred embodiment, if one layer were used for the hood (20), it may be preferable to use the opaque layer (41) which could shield the occupant from undesirable bright sunlight as well as other inclement weather. Each layer could have an attachment element, similar to attachment element (38) or securing element (24), which are designated as opaque attachment element (38*a*) and translucent attachment element (38*b*). Also shown in FIG. 2*g* is an integral pocket (44). The integral pocket (44) may be used to retain the protective cover when the protective cover is folded to a reduced state when the cover is not in use for easy storage. Obviously, other locations could be effective. For instance, the pocket (44) could be used as an accessory holder and could be located to the rearward end of the canopy, behind the first enclosing canopy section (12), for convenience.

As shown in FIGS. 1 and 2*d–f*, by leaving open a portion of the side mesh when the hood (20) is in use, the hood acts as a side-venting hood in that it allows venting through the remaining open side mesh for air flow. The air flow may be important in the physical comfort and health of the occupant. It may also be beneficial to the psychological piece of mind of the guardian or other person caring for the occupant. The opaque layer (41) may be made from nylon material. Nylon material may have some advantages in that it may be durable, washable, and flexible. Additionally, the nylon may be used for the protective foot shield in certain grades to reduce the proboscis penetration described above. For instance, a grade for nylon could be 200 denier nylon packcloth although other nylon grades could apply. Certainly, other materials than nylon could be suitable. Likewise, the canopy (11) can be made out of the same material. This may add to manufacturing ease and efficiency by using similar materials. Nylon may offer an additional benefit in that it may be breathable material and yet still resist the inclement weather such as rain, sleet, and snow and light. Obviously, to be effective, it would generally be more impermeable to inclement weather than the insect resistant mesh (15). One important feature of the present invention as opposed to other prior inventions is that the present invention may continue to resist the entry of insects into the inside volume (formed by the area of the canopy which is over the baby seat, as shown in FIG. 1, for instance) and provide air flow in the inside volume even while the hood (20) is protecting the occupant from inclement weather. The supporting member (22) may be made from any resilient material that can be self-supporting such as nylon tubing or General Electric Lexan® rod, among others. The mesh may be a 100 percent polyester fine weave mesh with a porosity of 40 denier that still could allow adequate air flow for the health of the occupant while resisting the entry of even small flying insects, as well as large crawling insects.

FIG. 2*h* shows an alternative embodiment of a hood. A side opening (17) of the hood (20) may coincide with an opening on the side mesh (15*b*) such that the hood could cover the canopy in a varied fashion. This might have an advantage if, for instance, severe wind was an issue, so that a lower area of the hood below the side opening could include securing elements such as hook and loop fasteners, snaps, or other appropriate securing elements known to those in the art. Additionally, if the side opening (17) included a mesh layer this might offer an additional layer of protection. Likewise, the attachment element (38) could surround more fully the hood (20) in the embodiment shown in FIG. 2*h* which might offer additional security and attachment to a baby seat such as shown in FIGS. 3*a–c*.

Furthermore, by orienting the mesh in different orientations, a filtering effect could occur, resulting in further sun shielding or other inclement weather shielding, while allowing air flow. FIGS. 2*i*–2*k* detail an alternate embodiment that may use a horizontal striped pattern version of the side mesh (I5) shown in FIG. 2 and the side opening (17) shown in FIG. 2*h*. One advantage of this embodiment could be to filter any inclement weather including sun rays through any side mesh (15*b*) remaining open and perhaps uncovered by the hood (20). While this embodiment, shown in FIGS. 2*i*–2*k*, is discussed in "horizontal stripe" terms, obviously other variations could filter or reduce the intensity of the inclement weather by using such filtering mesh. This could include mesh of differing patterns, vertical stripes, polarizing screen or plastic film, and so forth. This striped mesh, as shown in FIG. 2*j*, is labeled side stripe mesh (15*b*') and window stripe mesh (17') respectively to differentiate striped mesh from non-striped mesh. FIG. 2*i* shows that striped mesh could typically be used in the side striped mesh (15*b*') and not in the top mesh (15*a*), also shown in FIG. 2, for this embodiment. In FIG. 2, the side striped mesh (15*b*') may not be needed over boundary (27) also depicted in FIG. 2. FIG. 2*j* shows a possible overlapping relationship between the side striped mesh (15*b*') and the window striped mesh (17'). Depending upon the vertical relationship of side striped mesh (15*b*') and window striped mesh (17'), a filtering relationship for inclement weather such as light may exist. This filtering relationship can be manually adjusted by the custodian of the seat and occupant by, for instance moving the hood (20), to allow more or less light to enter the protective enclosure formed when the hood (20) in FIG. 2*h* is deployed. FIG. 2*k* provides a cross-sectional view with window striped mesh (17) deployed over cover (10) which is installed on seat (30). FIG. 2*k* also shows a possible relationship between the sealing element (24) for cover (10) and attachment element (38) for hood (20) to seat (30). Also FIG. 2*k* illustrates a possible relationship between the side striped mesh (15*b*'), top mesh (15*a*), and window striped mesh (17') along the boundary (27). FIG. 2*k* depicts inclement weather, such as outside light, as broad arrows (65) penetrating window striped mesh (17') and side striped mesh (15*b*'). Inside the enclosure are slight arrows (65) illustrating that a reduced amount of inclement weather, such as light, may enter the inside volume or space formed over the seated occupant. Air flow arrows (66) illustrate that adequate air flow may exist even though light could be significantly attenuated by passing between the interstitial space between the side striped mesh (15*b*') and the window striped mesh (17') on the hood (20).

FIG. 4 shows a typical installation of the protective cover over a baby seat having an attached handle (31) rotating about a pivot point (34). The embodiment shown may be a self-supporting canopy. Such a canopy could be supported by a supporting element (22), such as shown in FIG. 2*b*. One advantage of this embodiment is that the handle may be held, used, or even retracted independently of the self-supporting feature of the protective cover. Additionally, the protective cover could be supported by a supporting baby seat element (48), such as shown in FIG. 10. The supporting feature may offer significant advantages over various other inventions in conjunction with the unique features of the present invention as described herein. This feature may be particularly true when using a handled baby seat in a vehicle. Many manufacturers of baby seats recommend lowering the handle (31), generally rearward, for safety. Thus, an unsupported cover could simply lay on the occupant and may seem obtrusive to the occupant. A supporting protective cover could operate independently of the handle (31) or other external supports.

FIG. 5 shows that the protective cover can be embodied in various shapes and patterns. These shapes may be used to attract the occupant who may resist being enclosed in the inside volume. The shape as shown could include various attachments and could be modeled after animals or inanimate objects or other devices, including airplanes, as suitable. Generally, the shape or pattern of this invention may be such that the occupant could recognize and to which the occupant was attracted.

FIG. 6 shows yet another embodiment that contains a larger percentage surface area of the insect resistant mesh. Although the air flow is deemed to be adequate in FIG. 2, this embodiment may be appropriate for more warmer climates to increase the air flow. The embodiment, as shown, does not have a hood integral with the embodiment, although certainly a hood could either be temporarily fastened or permanently attached to the canopy (11), such as in FIG. 2.

FIG. 7 shows yet another embodiment of the protective cover. The protective cover has a smaller insect resistant mesh area. For instance, it might be more suitable for colder climates. Although a hood (20) is not shown, it certainly could be used as in other disclosed embodiments. Likewise, the canopy section (11) in colder climates could be made from insulating material. This insulating material is shown in more detail in FIG. 8 and FIG. 10. It could include, for instance, a top sheet (58), a bottom sheet (60) with insulation (62) interposed between the sheets, as a typical cross-section of the canopy (11). Also shown in FIG. 7 could be a side viewing window (54). This side viewing window (54) could include a translucent plastic window or it could be made from similar insect resistant mesh as has been described above.

Figure 9A:
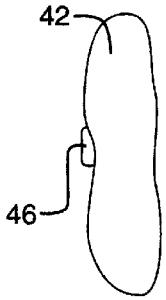

FIGS. 9 and 9*a* show the present invention in a reduced state. If the materials in the protective cover are flexible or otherwise capable of being reduced in size, the protective cover may be brought to a reduced state when the cover is not in use as a protective cover for the occupant. For convenience, an integral restraining element (42) may be attached to the protective cover (10) that may function to retain the cover (10) in the reduced state. Similarly, if the supporting element (22) is resilient or at least made to be reduced in size (by folding, for example) the supporting element (42) could also be brought to a reduced state such that the integral restraining element could overlap it as well. In the preferred embodiment, the protected cover (10) may be reduced to a substantially planer configuration, as shown in FIG. 9*a*. This configuration may offer some advantages for ease of storage. To assist the integral restraining element (42) to remain in a restrained state, a securing element (46) may be included and located at some appropriate location. Obviously, securing elements may vary; however, in the preferred embodiment, it appears that one set of snaps or even hook and loop type fasteners may be sufficient to restrain the integral restraining element (42). For convenience, the hood (20) may also function as the integral restraining element (42). Also, as described in FIG. 2*g*, an integral pocket (44) may also function as an integral restraining element (42) and may be positioned at a variety of places, including to the rearward of the cover. At that location (and others), it may additionally serve as an accessory pocket.

Another embodiment is shown in FIG. 10 where the protective cover is not necessarily self-supporting. In this embodiment, the protective cover could be supported by a supporting baby seat element (48). This baby seat element (48) may include sunshades that may be included with baby seats, straps, frame members, or other supporting devices.

FIG. 11 shows yet another embodiment of the present invention that includes the insect resistant mesh (15) and the canopy (11) with a partially covering hood (20). One advantage of a flexible hood is that it may be used in a variety of positions so that a variety of protection from inclement weather may be obtained for the given conditions. Also shown in FIG. 11 is a protective cover carrying element (50), as shown in FIG. 11*a*.

FIG. 11*a* shows one use of a protective cover carrying element (50). It may be a lanyard or a clip or some other suitable device to carry the protective cover in a convenient place when the cover is not in use. This protective cover carrying element (50) could be, for instance, attach the protective cover to a stroller or automobile seat for temporary storage.

In some instances, it might not be preferable to have a side venting embodiment. This situation could occur, for instance, in colder climates. One example is shown in FIG. 12 where the hood removably covers the insect resistant mesh.

Yet, another embodiment is shown in FIG. 13 where the protective cover is not necessarily self-supporting. In this embodiment, the protective cover could be supported by a supporting baby seat element (48). For instance, in this embodiment, the supporting baby seat element (48) may include a handle (31) as well as other supporting devices. The protective cover (10) may be fastened to the supporting baby seat element (48) by a cover support attachment (56). A cover support attachment (56) could include for instance, a hook and loop type of attachment or snaps or other suitable devices known to those in the art.

The methods that may be claimed in this invention are natural outgrowths of the apparatus claims and could include, for instance, suspending the canopy over a baby seat, sealing the canopy, supporting the canopy, utilizing a hood and allowing the hood to be retained in a rearward direction and alternative allowing the hood to be capable of hooding in a forward direction. It could also include resisting the entry of insects, (primarily flying insects), allowing an occupant to be viewed from an inside volume, and removably protecting from inclement weather while allowing air flow in the volume through a side vent in the canopy, for instance. It could also include protecting the feet of an occupant with a foot shield to reduce the proboscis penetration of such insects as mosquitoes or stinging insects that might penetrate through a mesh to feet that could touch the mesh or other parts of the body. It could also include integrally restraining the protective cover in a reduced state for easy transportation and storage, and other steps as would naturally occur with the above disclosure. Therefore, no separate discussions of the methods are deemed necessary as they may claim steps that are implicit in the use and manufacture of the apparatus claims. Furthermore, although the steps may be organized in a logical fashion, however, other sequences can and do occur. Therefore, any method claims should not be construed to include only the order of the sequence of steps presented.

The foregoing discussion and claims that may follow describe only the preferred embodiments of the present invention. While particular embodiments of the invention have been described, it will be obvious that changes and modifications may be made without departing from the broad aspects of the present invention. Particularly with respect to the claims, it should be understood that a number of changes may be made without departing from its essence. In this regard, it is intended that such changes—to the extent that they substantially achieve the same results in substantially the same way—would still fall within the scope of the present invention. It is simply not practical to describe and claim all possible revisions and claims to the present invention that may be accomplished. To the extent such revisions utilize the essence of the present invention, each would naturally fall within the breath of protection by any patent granted. This is particularly true for the present invention since most of the basic concepts are fundamental in nature and it can be properly applied.

Specifically, any references mentioned in the application for this patent as well as all references listed in any information disclosure originally filed with the application are hereby incorporated by reference in their entirety to the extent such may be deemed essential to support the enablement of the invention(s). However, to the extent statements might be considered inconsistent with the patenting of this/these invention(s) such statements are expressly not to be considered as made by the applicant.

I claim:

1. A method of protecting an occupant of a baby seat with a self-supporting protective cover comprising:

a. covering a space over a baby seat with a canopy supported by a laterally collapsible support element disposed across said canopy and removable with said canopy;

b. attaching said canopy at least partially around said baby seat with a seal attached to said canopy;

c. resisting an entry of insects flying into said space through said canopy and around said baby seat adjacent said canopy; and d. allowing air flow through a material on at least a portion of one side of said canopy while resisting said entry of said insects.

2. A method of protecting an occupant of a baby seat as described in claim 1 wherein attaching said canopy comprises sealing continuously around a perimeter of said canopy with said seal.

3. A method of protecting an occupant of a baby seat as described in claim 1 wherein allowing air flow comprises utilizing filtering mesh having at least a first mesh layer with a first air flow path and a second mesh layer with a second air flow path wherein said mesh layers at least partially overlap and at least a portion of the first air flow path is offset from at least a portion of the second air flow path to reduce light directed into said space.

4. A method of protecting an occupant of a baby seat as described in claim 3 wherein providing air flow comprises utilizes polarizing screen mesh.

5. A method of protecting an occupant of a baby seat as described in claim 1 further comprising:

a. continuing to resist said entry of said insects; and b. continuing to allow said air flow;

c. while deployable protecting said occupant from inclement weather with a hood attached to said canopy, the hood leaving a portion of said material uncovered to create a side venting window.

6. A method of protecting an occupant of a baby seat as described in claim 1 further comprising allowing said occupant to be viewed through at least a portion of said material while deployable protecting said occupant from inclement weather with a deployable hood.

7. A method of protecting an occupant of a baby seat as described in claim 1 wherein said support element is located in the vicinity of a midpoint of said canopy.

8. A method of protecting an occupant of a baby seat with a protective cover comprising:

a. covering said baby seat with said protective cover;

b. supporting said cover with a laterally collapsible support member connected across said cover;

c. allowing air flow into an inside volume created by covering said baby seat with said protective cover; and d. filtering inclement weather into said inside volume to a reduced level through a filtering mesh comprising a first mesh layer at least partially overlapped by a second mesh layer to reduce light directed into said inside volume while allowing said air flow.

9. A method of protecting an occupant of a baby seat as described in claim 8 further comprising resisting an entry of insects into said inside volume and wherein at least one of said mesh layers comprises striped mesh.

10. A method of protecting an occupant of a baby seat as described in claim 8 further comprising allowing said occupant to be viewed from outside said inside volume through a material attached to said cover.

11. A method of protecting an occupant of a baby seat as described in claim 8 further comprising deployable protecting said occupant from inclement weather with a hood attached to a portion of said cover while allowing air flow in said inside volume through at least a portion of a side vent of said protective cover.

12. A self-supporting protective cover for a baby seat comprising:

a. a canopy having a top and at least one side disposed adjacent said top and supported by a laterally collapsible support element attached across said canopy;

b. a sealing element attached to said canopy and adapted to at least partially seal said canopy over said baby seat; and c. an insect resistant mesh attached to said canopy, the mesh having a portion over said baby seat wherein said canopy is adapted to completely resist the entry of insects into a space between said canopy and said baby seat occurring by flying either through said canopy or around said baby seat adjacent said canopy.

13. A protective cover for a baby seat as described in claim 12 further comprising a protective foot shield attached at least to a lower portion of said canopy and adapted to protect feet of said occupant wherein said protective foot shield comprises a different material of a harmful portion of an anatomy of an insect.

14. A protective cover for a baby seat as described in claim 12 wherein said lateral support element is attached to said canopy in the vicinity of a midpoint of said canopy.

15. A protective cover for a baby seat as described in claim 12 wherein said side of said canopy at least partially comprises insect resistant mesh and further comprising a flexible hood attached to said canopy that is adapted to not cover at least a portion of said insect resistant mesh on said side when said flexible hood covers a portion of said canopy to create at least one side vented window.

16. A protective cover for a baby seat as described in claim 15 wherein said hood attaches to said canopy in the vicinity of a midpoint of said canopy.

17. A protective cover for a baby seat as described in claim 15 wherein said mesh extends continuously from one side across the top to the other side of said canopy.

18. A protective cover for a baby seat as described in claim 12 further comprising a hood attached to said canopy at a location on said canopy that enables said hood to be retained in an unhooded rearward direction and at least a partially hooded forward direction over said canopy.

19. A method of protecting an occupant of a baby seat with a protective cover comprising:

a. covering said baby seat with a flexible canopy having a top and sides disposed adjacent said top;

b. supporting said canopy with a laterally collapsible support member connected across said canopy;

c. at least partially sealing said canopy about said baby seat;

d. resisting an entry of insects flying into a space created by said canopy disposed over said baby seat;

e. folding said cover to a reduced state when said cover is not installed on said seat; and f. substantially enveloping said canopy in said reduced state with an integral restraining element attached to said canopy.

20. A method of protecting an occupant of a baby seat as described in claim 19 further comprising protecting feet of said occupant from a harmful portion of an anatomy of an insect with a portion of said canopy being a protective foot shield while covering said baby seat.

21. A method of protecting an occupant of a baby seat as described in claim 19 further comprising deployable protecting said space under said canopy from inclement weather while allowing air flow with a deployable hood comprising leaving open at least a portion of a side vent of said canopy.

22. A self-supporting protective cover for a baby seat comprising:

a. a canopy having a top and at least one side disposed adjacent said top and supported by a lateral support element attached to said canopy;

b. a sealing element attached to said canopy and adapted to at least partially seal said canopy over said baby seat; and c. an insect resistant mesh attached to said canopy, the mesh having a portion over said baby seat; and d. a hood attached to said canopy at a location on said canopy that enables said hood to be retained in a unhooded rearward direction and at least a partially hooded forward direction over said canopy wherein said canopy is adapted to completely resist the entry of insects into a space between said canopy and said baby seat occurring by flying either through said canopy or around said baby seat adjacent said canopy and wherein said hood is retained by an elastic element attached to said hood, such that said elastic element engages said baby seat.

23. A method of protecting an occupant of a baby seat comprising:

a. covering a space over said baby seat with a self-supporting protective cover comprising a canopy, said canopy supported by a laterally collapsible support element attached to said canopy and disposed across said canopy;

b. attaching said canopy at least partially around said baby seat with a seal attached to said canopy;

c. resisting an entry of insects flying into space through said canopy and around said baby seat adjacent said canopy; and d. allowing air flow through a material on at least a portion of one side of said canopy while resisting said entry of said insects.

24. A protective cover system comprising:

a. a baby seat;

b. a self-supporting cover comprising a canopy covering said baby seat and having a top and at least one side disposed adjacent said top and having by a laterally collapsible support element attached to said canopy, said canopy being adapted to completely resist the entry of insects into a space between said canopy and said baby seat occurring by flying either through said canopy or around said baby seat adjacent said canopy;

c. a sealing element attached to said canopy and adapted to at least partially seal said canopy over said baby seat; and d. an insect resistant mesh attached to said canopy, the mesh having a portion over said baby seat.

* * * * *